US005085160A

United States Patent [19]

Hashiride et al.

[11] Patent Number: 5,085,160

[45] Date of Patent: Feb. 4, 1992

[54] THREAD CUTTING DEVICE FOR USE IN A SEWING MACHINE

[75] Inventors: Tadaaki Hashiride, Okazaki; Toshiyuki Nakai, Toyoake; Hisaharu Goto, Nagoya, all of Japan

[73] Assignee: Aisin Seiki Kabushiki Kaisha, Kariya, Japan

[21] Appl. No.: 603,147

[22] Filed: Oct. 25, 1990

[30] Foreign Application Priority Data

Oct. 26, 1989 [JP] Japan ..... 1-279376

[51] Int. Cl.[5] ..... D05B 65/02; D05B 69/36

[52] U.S. Cl. ..... 112/300; 112/277; 83/902

[58] Field of Search ..... 112/292, 285, 291, 294, 112/295, 296, 297, 298, 300, 275, 277, 121.11; 83/902

[56] References Cited

U.S. PATENT DOCUMENTS 3,665,878 5/1972 Koschoff et al. ..... 112/300 X 4,104,978 8/1978 Takahashi et al. ..... 112/277

4,173,193 11/1979 Morinaga et al. ..... 112/300 X

*Primary Examiner*—Peter Nerbun

*Attorney, Agent, or Firm*—Oblon, Spivak, McClelland, Maier & Neustadt

[57] ABSTRACT

A device includes a driving device for driving an upper shaft. A moving blade is connected to the driving device via a clutch mechanism so as to be rotated by the driving device during on-condition of the clutch mechanism. A stationary blade cuts a thread held by a holding member in cooperation with the moving blade. A detecting device stops driving of the driving device based on a signal indicating the terminating of the moving blade while the moving blade and the driving device are connected. A range detecting device detects the rotation range of the upper shaft when the driving device is stopped based on a signal from the detecting device. A restarting device restarts the driving device based on a signal from the range detecting device.

4 Claims, 3 Drawing Sheets

THREAD CUTTING DEVICE FOR USE IN A SEWING MACHINE

BACKGROUND OF THE INVENTION

1. Field of the Invention

This invention relates to a thread cutting device for use in a sewing machine and the like, and more particularly to a thread cutting device for use in an automatic sewing machine and the like.

2. Description of the Related Art

In the conventional type of the thread cutting device, a thread held by a holding member is caught by a moving blade which is rotated by a driving means such as a motor, and is then cut by the cooperation of the moving blade and a stationary blade.

It is desirable that the driving means be miniaturized from the view points of light weight and cost saving since then the sewing machine can be driven with small power. However, if the driving power for rotating the moving blade to cut the thread becomes insufficient, the thread may be pulled between the moving blade and the hold member, due to the tension, the radius etc. of the thread, before the cooperation of the stationary blade and the moving blade can cut the thread. Therefore the moving blade is stopped. The driving means is then stopped by a signal from a detection means and the operator has to restart the cutting operation, and this is very cumbersome.

SUMMARY OF THE INVENTION

It is an object of the invention to provide an improved thread cutting device which obviates the above conventional drawbacks.

It is another object of the invention to provide an improved thread cutting device which can restart the thread cutting operation automatically in spite of the termination of movement of the moving blade before the thread is cut thereby.

In order to attain the foregoing objects, a thread cutting device according to the present invention is comprised of driving means for driving an upper shaft, a moving blade connected to the driving means via a clutch mechanism so as to be rotated by the driving means during on-condition of the clutch mechanism and a stationary blade that cuts a thread held by a holding member in cooperation with the moving blade. Detecting means are provided for stopping driving of the driving means based on a signal indicating the terminating of movement of the moving blade while the moving blade and the driving means are connected. Range detecting means then detect the rotation range of the upper shaft while the driving means is stopped by the detecting means. Restarting means restart the driving means based on a signal from the range detecting means.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENT

Figure 1:
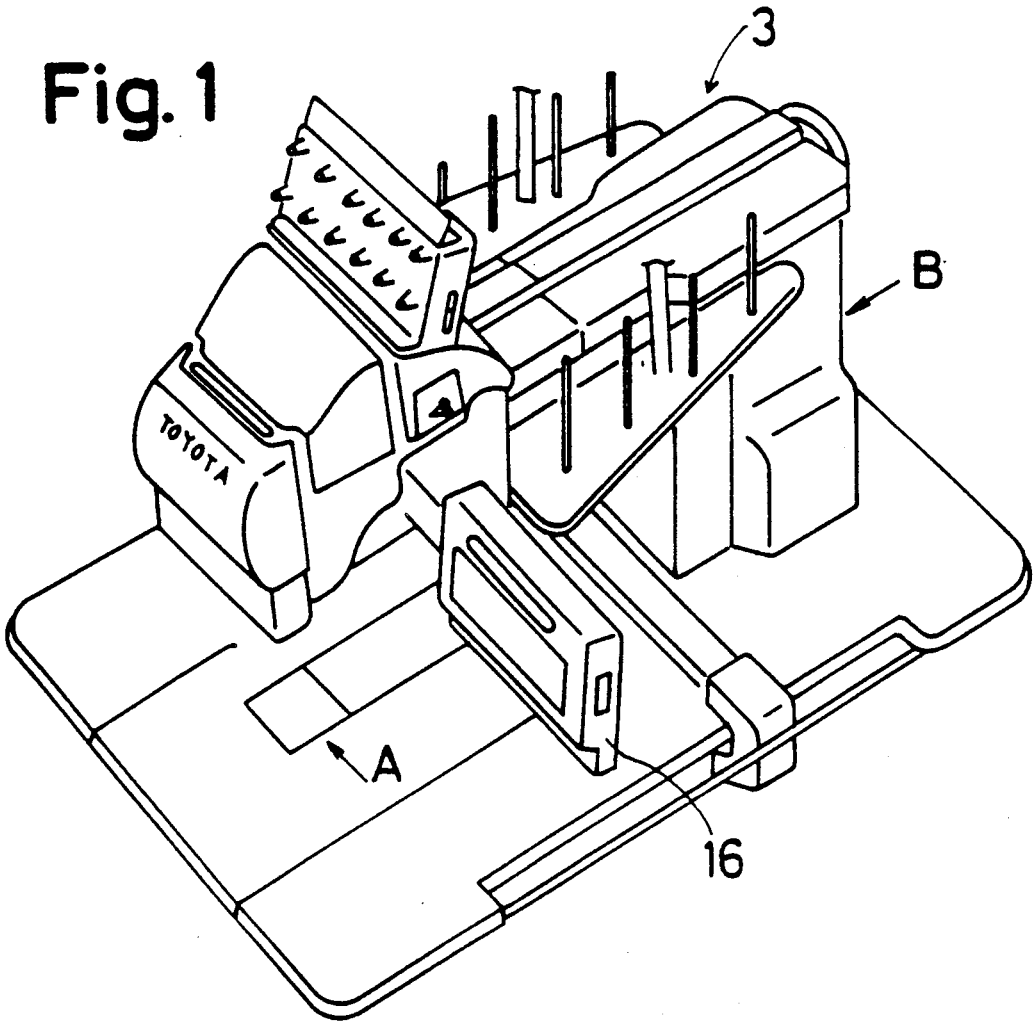
FIG. 1 is a perspective view showing an embroidery sewing machine using the thread cutting device of one preferred embodiment of the present invention.

Referring to FIG. 1, there is illustrated an automatic embroidery sewing machine 3 which performs an embroidery sewing operation by feeding a work or a cloth automatically by means of two motors 1 and 2 based on embroidery data. The sewing machine 3 has a thread cutting mechanism 4 located at a position A and a driving mechanism 5 located at a position B for operating the thread cutting mechanism. The structures of the thread cutting mechanism 4 and the driving mechanism 5 are shown in detail in FIGS. 3 and 2, respectively.

Figure 2:
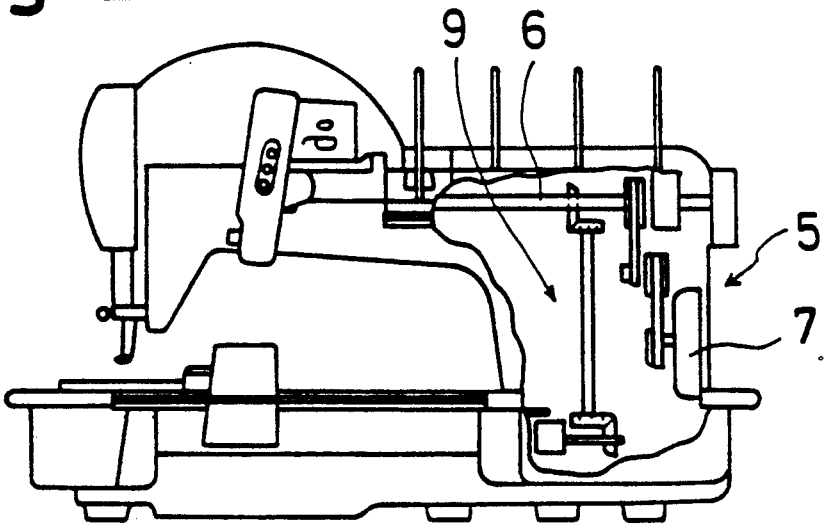
FIG. 2 is an elevation view showing a driving mechanism of the present invention.

As shown in FIG. 2, the driving mechanism 5 has a motor 7 for driving the upper shaft 6 and a clutch mechanism 9 for connecting the motor 7 to the thread cutting mechanism 4, via the upper shaft 6, when a thread cutting solenoid 8 is actuated.

Figure 3:
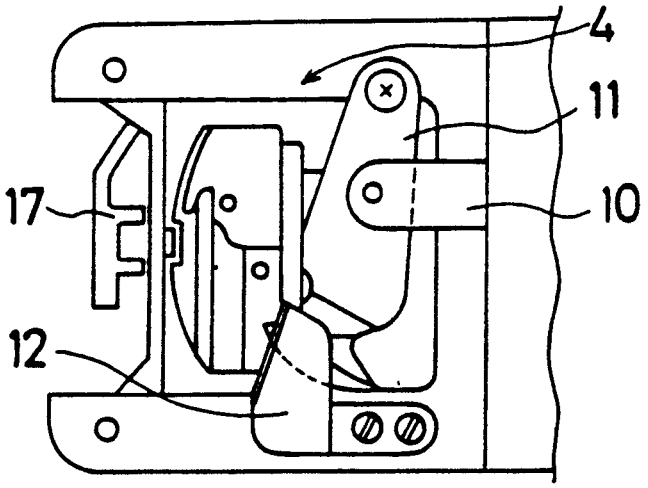
FIG. 3 is a detail showing a thread cutting mechanism of the present invention.
Figure 6:
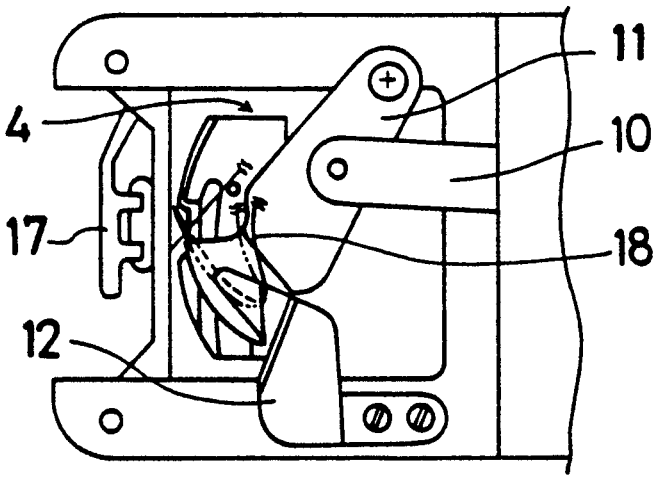
FIG. 6 is a view showing the thread cutting mechanism of the FIG. 3 in a condition for cutting the thread.

As shown in FIG. 3, the thread cutting mechanism 4 has a moving blade 11 which is rotated by the motor 7 via a link mechanism 10 and the upper shaft 6 connected thereto, and a stationary blade 12 for cutting a thread 18 (FIG. 6) in cooperation with the moving blade 11 which is in rotation. The motors 1, 2 and 7, and the solenoid 8, are under the control of a control circuit 13 shown in FIG. 4 and are operated automatically. The control circuit is preferably a programmable digital controller.

Figure 4:
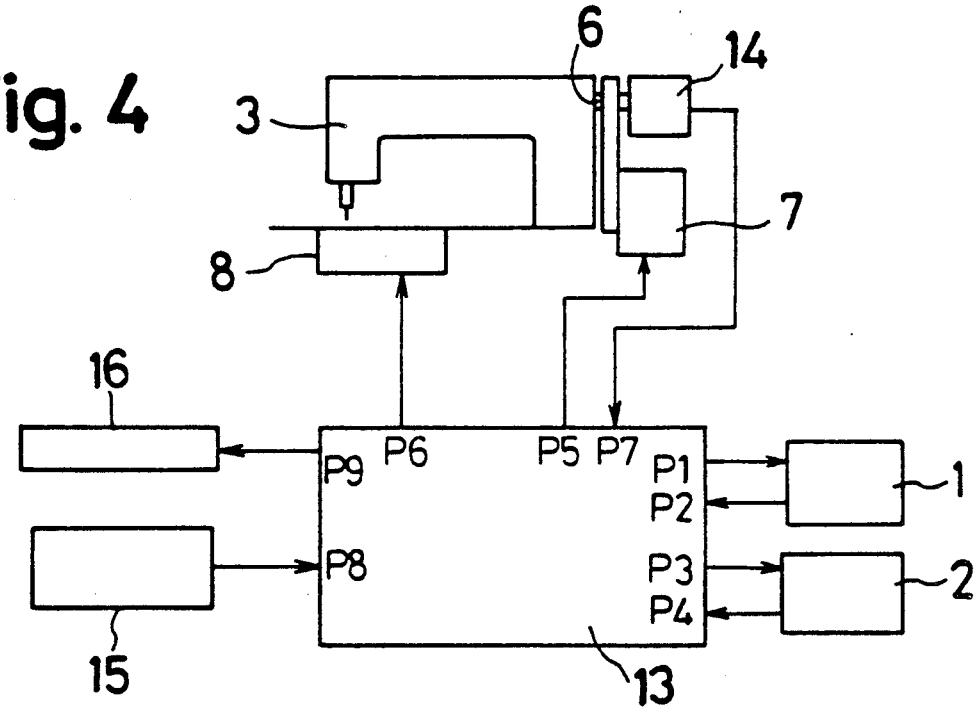
FIG. 4 is a schematic diagram of the electric control circuit for the thread cutting mechanism of the present invention.

As shown in FIG. 4, the motor 1 is connected to an input port P1 and an output port P2 of the circuit 13, and the motor 2 is connected to an input part P3 and an output port P4. An output port P5 is connected to the motor 7 and an output port P6 is connected to the solenoid 8. An input port P7 is connected with an encoder 14 which is mounted on the upper shaft 6 for detecting the rotational angle thereof. An input port P8 is connected to switch means 15 and an output port P9 is connected to a display 16 attached to the sewing machine 3.

Figure 5:
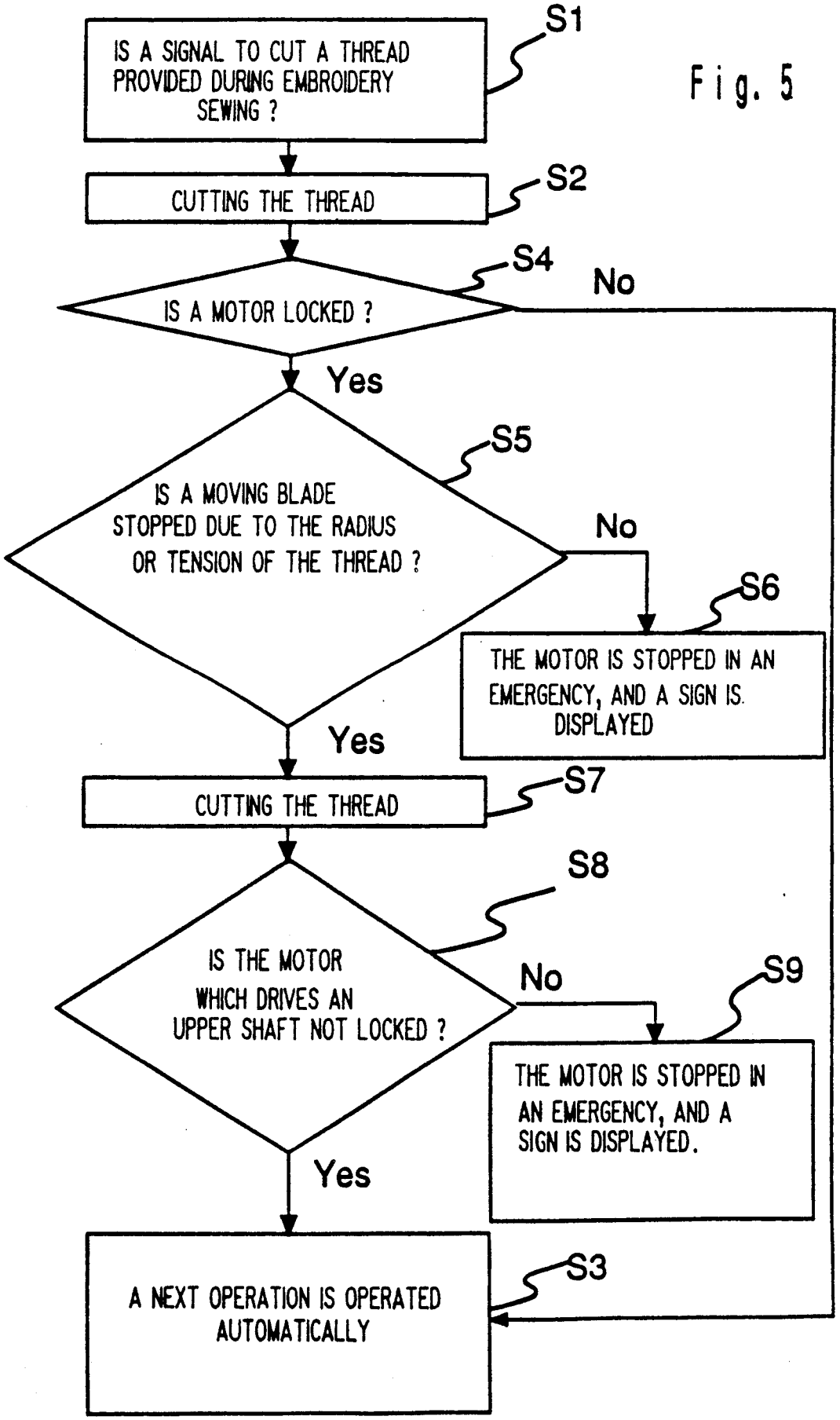
FIG. 5 is a flowchart showing the control sequence of the circuit in FIG. 4.

In operation, when an input switch of the switch means 15 is closed, the desired embroidery data is inputted to the circuit 13 from a memory means (not shown). Thereafter, when an operation switch of the switch means 15 is closed, the motors 1, 2 and 7 are turned on, thereby performing the embroidery sewing operation based on the embroidery data. When one cycle of the embroidery sewing operation is terminated, a thread cutting signal in the data is read (step S1 in FIG. 5), thereby actuating the solenoid 8. Therefore a connection between the upper shaft 6 and the link mechanism 10 is established by means of the clutch mechanism 9 (step S2), thereby rotating the moving blade 11. Then, the thread 18 held by a holding member 17 is caught by the resulting moving blade 11 and is cut by the cooperation of the moving blade 11 and the stationary blade 12. After this, the next operation is carried out automatically.

Until the thread is caught by the cooperation between the stationary blade 12 and the moving blade 11, the thread 18 is being tensioned between the moving blade 11 and the holding member 17. Under this condition, due to the radius or the tension of the thread 18, the moving blade 11 sometimes stops, whereby the motor 7 is automatically turned off. When the termination of operation of the motor 7 is detected (step S4), the rotational angle of the upper shaft 6 is detected by the encoder 14. A check is then performed as to whether the termination of movement of the moving blade 11 is due to the radius or tension of the thread as shown FIG. 6, by comparing the detected rotational angle of the upper shaft 6 and rotational angle range of the upper shaft 6 stored in the circuit 13 (step S5). If the former is not within the latter, an error indication is indicated on the display 16 (step 6) and operation of the sewing machine 3 is terminated. If the former is within the latter, the motor 7 is actuated again and the thread cutting operation initiated again (step S7). At this time, since the thread 18 is loosened to some extent due to the temporary stoppage of the motor 7, the thread 18 is cut by the cooperation of the stationary blade 12 and the moving blade 11, which is restarted with high motive power. Then, the next operation is performed (step 3). When the moving blade 11 and motor 7 are detected to be terminated in spite of the restart of the motor 7 (step S8), the error display is indicated on the display 16 and the sewing machine 3 is stopped (step S9).

As mentioned above, though the motor 7 is stopped subsequent to the termination of movement of the moving blade 11 due to the radius or tension of the thread 18 during the thread cutting operation, the thread 18 can be cut surely by utilizing the looseness of the thread 18 or the motive power of the motor 7 after restarting the motor 7. Therefore an operator need not perform a manual operation for restarting the thread cutting operation, thereby reducing his/her burden.

Obviously numerous modifications and variations of the present invention are possible in light of the above teachings. It is therefore to be understood that within the scope of the appended claims, the invention may be practiced otherwise than a specifically described herein.

What is claimed is:

1. A thread cutting device for use in a sewing machine comprising:

driving means for driving an upper shaft;

a moving blade connectable to said driving means via a clutch mechanism so as to be rotated by said driving means during an on-condition of the clutch mechanism;

a stationary blade positioned to cut a thread held by a holding member, in cooperation with said moving blade;

detecting means for detecting the termination of movement of the moving blade while said moving blade and said driving means are connecting by said clutch mechanism, and for stopping movement of said driving means in response to a detected termination of said movement;

range detecting means for detecting the rotation angle of said upper shaft when said driving means is stopped by said detecting means; and restarting means for restarting said driving means based on a signal from said range detecting means.

2. A thread cutting device for use in a sewing machine according to claim 1, wherein said driving means is a motor.

3. A thread cutting device for use in a sewing machine according to claim 1, wherein said clutch mechanism is a solenoid actuated clutch.

4. A thread cutting device for use in a sewing machine according to claim 1, wherein said restarting means comprises means for restarting said driving means when said range detecting means detects that an actual rotational angle of said upper shaft is less than a predetermined rotational angle.

* * * * *